United States Patent [19]

Spaziante et al.

[11] 4,019,968

[45] Apr. 26, 1977

[54] ELECTROCHEMICAL CELL

[75] Inventors: Placido M. Spaziante; Carlo Traini, both of Milan, Italy

[73] Assignee: Parel Societe Anonyme, Luxembourg, Luxembourg

[22] Filed: May 27, 1975

[21] Appl. No.: 580,691

[30] Foreign Application Priority Data

May 30, 1974 United Kingdom ..... 24077/74

[52] U.S. Cl. ..... 204/23; 204/254; 204/268

[51] Int. Cl.[2] ..... C25D 5/04; C25D 17/12

[58] Field of Search ..... 204/222, 254–256, 204/268, 23

[56] References Cited

UNITED STATES PATENTS

| | | | |
|---|---|---|---|
| 3,312,614 | 4/1967 | Schick | 204/255 |
| 3,654,098 | 4/1972 | Backhurst et al. | 204/222 |
| 3,703,446 | 11/1972 | Haycock et al. | 204/222 |
| 3,761,383 | 9/1973 | Backhurst et al. | 204/268 |
| 3,778,362 | 12/1973 | Wiechers et al. | 204/256 |
| 3,864,236 | 2/1975 | Lindstrom | 204/256 |

*Primary Examiner*—T. M. Tufariello
*Attorney, Agent, or Firm*—Armstrong, Nikaido & Marmelstein

[57] ABSTRACT

There is disclosed an electrochemical apparatus including two or more electrochemical cells arranged in series. Each of the cells has at least one particulate electrode and is separated from its adjacent cells by a bipolar member which constitutes a current feeder for at least one particulate electrode. The apparatus is particularly useful in processes for the electrodeposition of metal onto the particles of a particulate cathode.

14 Claims, 13 Drawing Figures

ELECTROCHEMICAL CELL

BACKGROUND OF THE INVENTION

This invention relates to electrochemical apparatus and processes and, more particularly but not exclusively, is concerned with electrochemical apparatus employing particulate cathodes and with electrodeposition processes carried out using such electrochemical apparatus.

In general, electrochemical processes may be considered as being either cathodic processes or anodic processes depending on the electrode at which the economically important reaction occurs. Most cathodic processes involve either electrodeposition of a metal or electrolytic reduction of a constituent of the electrolyte in the presence of hydrogen formed at the cathode; in the former class of cathodic process are electroplating, electrorefining and electrowinning and in the latter class are the reduction of organic compounds and the production of caustic soda. Most anodic processes involve either the discharge of anions from solution at an essentially stable anode or the dissolution of the anode itself; in the former class of anodic process are processes for the production of chlorine and oxygen and in the latter class are processes for recovering valuable metal from scrap and the refining or purification of metals. Details of conventional industrical electrochemical processes are given inter ali in the book entitled "Industrial Electrochemical Processes" edited by A. Kuhn and published in 1971 by the Elsevier Publishing Company.

A number of electrochemical processes make use of so-called bipolar electrodes. These bipolar electrodes have one face at which a cathode reaction occurs and another face at which an anode reaction occurs. Bipolar electrodes have found application inter alia in electroplating processes where metal is electrodeposited on the cathodic face of the bipolar electrode but passes into solution at the anoidic face thereof. There are some electrochemical processes where the electrodes maintain substantially constant dimensions as the cell reaction proceeds, e.g. where both the anode and cathode reactions comprise the evolution of a gas at the surface of the respective electrode, in which bipolar electrodes have been used as separators to separate adjacent cells in an assembly of electrochemical cells arranged in electrical series. However, in electrochemical processes where the dimensions of one of the electrodes changes as the cell reaction proceeds, e.g. when there is electrodeposition of metallic ions onto the cathode, the use of bipolar electrodes to separate adjacent cells has not been practicable because of the need to periodically remove from the cell, and replace, electrodes whose dimensions change as the cell reaction proceeds.

There have recently been described various forms of electrochemical apparatus which essentially comprise an electrochemical cell having an ion-permeable diaphragm disposed between the electrodes of the cell and in which the cathode is a particulate electrode comprising a pluraliuty of electroconductive particles on which, for example, a metal can be electrodeposited; one such apparatus is described, for example, in Belgian Pat. Spec. No. 818,453, this apparatus including an electrode system, suitable for use with an anodic counter electrode to perform an electrochemical process, which electrode system comprises a particulate cathode, a current conductor (frequently known as a current feeder), a vessel which contains the particle cathode and current conductor and has one ion-permeable wall at least a part of which is inclined towards and overlies the particulate electrode, and means for flowing a fluid medium through the vessel in contact with the particulate cathode. Other examples of particulate electrodes are disclosed in, for example, British Pat. Specification No. 1,194,181, U.S. Pat. Spec. Nos. 3,180,810, 3,527,617 and 3,551,207 and French Pat. Specification No. 1,500,269. Electrochemical apparatus employing particulate cathodes can be used, inter alia, in processes for electrowinning metals. Thus, Belgian Pat. Specification No. 818,453 discloses a process for electrowinning a metal from an electrolyte comprising an aqueous solution of one or more salts of a metal in which process the electrolyte is passed through a cathode compartment of an electrochemical cell, the cathode compartment comprising an electrode system of the type defined above, whilst small electroconductive particles are fed to the cathode compartment, wherein they form part of the particulate cathode, and enlarged particles on which metal has been electrodeposited are extracted from the cathode compartment, the distribution of the particles of the particulate cathode in the cathode compartment being controlled during the process in a manner such that substantially all the particles are circulated between first and second regions formed within the cathode compartment, the first region being adjacent to the ionpermeable wall, within which first region substantially all the particles are for a large proportion of the time they spend in the first region, out of contact with each other, and the second region being spaced from the ionpermeable wall, within which second region substantially all the particles are, for a large proportion of the time they spend in the second region, in contact with other particles.

SUMMARY OF THE INVENTION

According to a first aspect of the present invention there is provided an electrochemical apparatus which includes two electrochemical cells separated from each other by a bipolar member wherein each of said cells has at last one particulate electrode and a counter electrode and wherein, in use, the bipolar member provides an electrical connection between the particulate electrode of one cell and the counter electrode of the other cell, the arrangement being such that, in use, at least a part of the bipolar member is in electrical contact with the particulate electrode and constitutes a current feeder for the particulate electrode.

Although the apparatus of the present invention can consist of only two electrochemical cells it is envisaged that, in the commercial application of the invention, it will be preferable to provide apparatus which includes more than two cells arranged in electrical series with adjacent cells being separated by a biplar member. It is believed that the preferred number of cells in such apparatus would be in the range of from 5 to 100 cells and most preferably in the range of from 10 to 30 cells.

According to a second aspect of the present invention there is provided a process for the electrodeposition of a metal from an aqueous electrolyte onto the particles of two or more particulate electrodes which process comprises the steps of flowing the aqueous electrolyte through an apparatus according to the first aspect of the invention so as to contact the particulate electrodes thereof and establishing between the particulate electrode and the counterelectrode of each cell of the apparatus a potential difference which is such as to render the particulate electrode in each cell of the apparatus cathodic with respect to the counter electrode of the cell whereby metal is electrodeposited from the electrolyte on to the particles of each particulate electrode.

The bipolar member used in the apparatus of the present invention will generally comprise a plate-like portion which, in use, serves to separate the two, or any two adjacent, cells of the apparatus. The plate-like portion has two major faces and, in use, one of the faces will be in contact with the particulate electrode whilst the other of the faces will be in contact with or will constitute the counter electrode of an adjacent cell. At least a part of that face of the bipolar member which is in contact with the particulate electrode is adapted to pass electrical current to or from the particles of the electrode, i.e. it will serve as a current conductor, or current feeder, for the particulate electrode.

The bipolar members used in the apparatus of the present invention differ from known bipolar electrodes in that at least a part of one face of the bipolar member serves as a current feeder, passing current to (or from) the particles of the particulate electrode with which it is in contact. In known bipolar electrodes, both faces serve as electrodes on whose surfaces an electrode reaction takes place. In many applications of these biplar electrodes, it is therefore important to provide as large an area of electrode surface within the cells as possible. However, with the bipolar members of this invention, at least one or a part of one of the faces of the biplar member functions as a current feeder whose active area need only be a small fraction of the area of the particulate electrode which it contacts. The reason for this is that an electrode reaction at a particulate electrode takes place on or adjacent the particles of the electrode, and the purpose of the current feeder is solely to conduct electrical current to (or from) the particles of the particulate electrode. Although there may be some electrode reaction at the surface of the current feeder when the particulate electrode is not functioning efficiently, it is generally desirable that there should be no reaction at the surface of the current feeder. The construction of the current feeder should be such as to function with high efficiency and we have found that this may be achieved in particulate electrodes having a bed of copper particles with a current feeder whose active area is only a small percentage, for example 5–20%, of the vertical cross-sectional area of the particulate electrode. However, when particulate electrodes employing particles less electroconductive than cooper are used, current feeders having an active area of up to 50% of such area may be necessary. Generally, the current feeder should not extend into those regions of the electrode compartment in which the distribution of particles and the electric field is such as to allow significant electrodeposition of metal thereon.

In a particulate electrode, the surface area on which the electrode reaction takes place is usually at least an order of magnitude greater than that of a planar electrode in a cell of similar dimensions. In a cell having one particulate electrode and one planar electrode it may therefore be convenient to increase the active surface area of the planar electrode so that it can more closely approach that of the particulate electrode. Furthermore, if an electrode reaction involving the evolution of a gas occurs at the planar electrode it is important that there is provision for the rapid escape of bubbles of evolved gas from the surface of the electrode. One way of increasing the surface area of a planar electrode and of allowing rapid escape of evolved gases is to form the electrode as a mesh or grid. A bipolar member forming part of the apparatus of this invention (which has one face of which at least a part acts as a current feeder and a second face of which at least part acts as a counterelectrode) will usually be constructed so that the ratio of the electrically active area of the first face to that of the second face is in the range of from 1:2 to 1:10 often about 1:5. In conventional bipolar electrodes the ratio of the electrically active areas of the faces which function as electrodes more usually approximates to 1:1. The construction of a current feeder is often markedly different from that of an electrode. The construction of an electrode is such as to encourage the continued progress of an electrode reaction on its surface. This is achieved by making the surface area of the electrode large and frequently by coating the surface in an electrocatalytically active substance. The surface must withstand the corrosive effects of, and any stresses associated with, the electrode reaction. The construction of a current feeder, on the other hand, is such as to ensure efficient electrical contact between it and the particles of the electrode to which (or from which) it feeds current. Such efficient electrical contact reduces to insignificant levels the potential difference between the current feeder and the particles adjacent it and this helps to reduce the tendency for an electrode reaction to occur on the surface of the current feeder. Efficient electrical contact between the current feeder and the electrode particles can be achieved by recessing the current feeder into a wall of the electrode compartment in which the particulate electrode is housed so that its face is flush with the compartment wall. Furthermore, the movement of the particles of the particulate electrode is not obstructed by such a recessed current feeder. It is thought that such obstruction causes particles to adhere to the surface of the current feeder and to agglomerate there.

Normally in apparatus according to the invention, the electrodes of each cell will be separated by an ion-permeable diaphragm whereby there is formed in each cell an anode compartment and a cathode compartment. Such an ion-permeable diaphragm serves to prevent the particles of the particulate electrode from making electrical contact with the other electrode of the cell and thus shorting the cell. The ion-permeable diaphragm can be fluid-permeable or it can be substantially fluid-impermeable and ionically permselective. Fluid-impermeable diaphragms are suitable for use in electrochemical processes in which it is desirable that the electrolyte surrounding the anode be prevented from making contact with the electrolyte surrounding the cathode.

In one application of the present invention, apparatus comprising a plurality of cells, each of which has a particulate cathode and a non-particulate anode separated from each other by an ion-permeable membrane, is employed to electrolyze an aqueous solution containing sulphate ions and metal ions. In this way, oxygen can be generated at the anode while metal can be electrodeposited onto the particles of the cathode. Thus, an apparatus according to the invention can be used in a process for electrowinning metal from an aqueous sulphate solution derived, for example, from a metallic ore. In accordance with one embodiment of the present invention there is provided an apparatus comprising a plurality of electrochemical cells in which plate-like members separate adjacent cells, the plate-like members each having a first surface suitable for service as an anode in one cell and a second surface at least a part of which is suitable for service as the current feeder for a particulate cathode in the adjacent cell, the two surfaces being in electrical contact with each other through the bulk of the plate-like member; the plate-like members thus serve as bipolar members. The plurality of cells are conveniently arranged in a configuration similar to that of a plate filter press, and electrical connections to an external source of electrical power for the cell reaction are made solely at each end of the configuration. The plate-like members substantially serve to prevent passage between adjacent cells of electrolyte, ions or the particles of the particulate electrodes.

Titanium often provides a convenient material from which the plate-like bipolar members can be formed when they are to be used in an electrodeposition process according to the second aspect of the invention. This is because, under the particular conditions found in many of these processes, titanium is relatively inert. Materials other than titanium may be employed, but it is desirable that they should show inertness to the reaction conditions prevailing. A number of metal rods or a wire mesh may conveniently be welded to what becomes, in use, the anode side of the titanium plate, the rods or wire mesh preferably having a coating which electrocatalytically active such that these coated surfaces act as anodic surfaces, whereas uncoated areas of the rods or mesh and other areas of the anode side of the titanium plate remain inert. It may be convenient to provide a protective, non-conductive coating of titanium oxide on the areas of the anode side of the titanium plate which are to remain inert. The composition of the electrocatalytically active anode coating is chosen having regard to the operating conditions of the cell, for instance, the current density, particular anode reaction and electrolyte composition; and the chosen material should have considerable resistance to corrosion so that the anode is dimensionally stable in these conditions. The anode coating may comprise one or more noble metals (platinum being particularly suitable) or noble metal oxides or mixtures of noble metal oxides with base metal oxides; transition metals, metal alloys and metal oxides, such as lead, stainless steels, lead dioxide or manganese dioxide, may also be useful. Examples of such coatings are disclosed in, for example, U.S. Pat. Spec. Nos. 3,616,445; 3,632,498 and 3,711,385.

The plate-like bipolar member used in the apparatus of the invention may be bimetallic, having an anode-side surface and construction as described above and, for example, a copper plate current feeder forming a part of the current feeder side surface of the member. The current feeder side surface of the member may be further modified to improve its efficacy in use by insulating parts of the plate so that they can no longer make contact with the particulate cathode. The parts of the plate could be insulated by providing on their surface, for example, a layer of titanium oxide, an insulating paint, a plastics coating or thin plastics sheet. Alternatively the area of the current feeder may be increased by introducing such devices as electrically conductive vertical fins normal to and in electrical contact with the surface of the plate. However, it has been found that in the cells described in the Examples given hereinafter, a current feeder of relatively small active area with no fins was satisfactory. Indeed, the presence of fins on the current feeder in the processes described in the Examples may be disadvantageous in that such fins may disturb the flow of particles over the surface of the current feeder and give rise to the agglomeration of particles on the current feeder. However, the use of the fins may be desirable or necessary in other electrochemically processes in which the electrical contact between the particles at the current feeder is less good, for example when the particles of the electrode are more widely distributed or when their surfaces are of a poorly conductive material.

In the Examples described hereinbelow, the particulate electrodes include in the apparatus used were in general principle of a construction as disclosed in Belgian Patent Specification No. 818,453. That is, each particulate electrode forms part of a particulate electrode system comprising a plurality of electroconductive particles and a current feeder contained in a vessel having an ion-permeable wall at least a part of which is inclined towards and overlies the particulate electrode. At the base of the vessel is a flow distributor through which in use an electrolyte is flowed so as to contact the particulate electrode and to cause its constituent particles to circulate around the vessel, generally upwardly adjacent the ion-permeable diaphragm and downwardly adjacent the current feeder. The establishment of such circulatory movement of particles causes the volume of the bed of particles to increase over the volume which it occupies when it is in a static, settled state. It has been found that, when used in the apparatus of the present invention, such circulatory particulate electrodes are conveniently operated at an overall volume bed expansion in the range of from 5 to 10% when the ionpermeable diaphragm is inclined at an angle in the range of from 5° to 40°, preferably 10° to 30°, from the upward vertical to overlie the particulate electrode.

For a better understanding of the invention and to show more clearly how the same may be carried into effect, reference will now be made, by way of example, to the accompanying drawings in which.

Figure 5A:
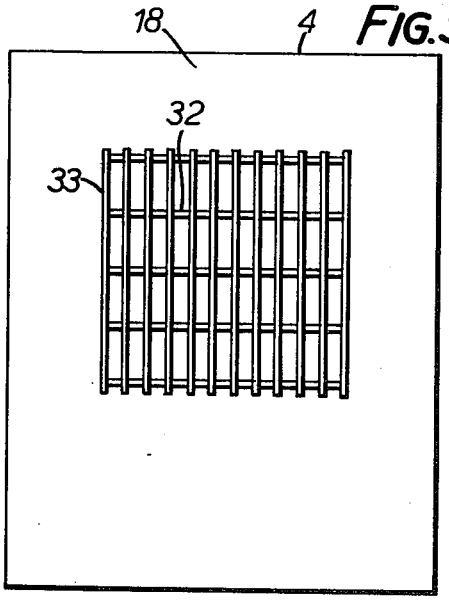
Figure 5B:
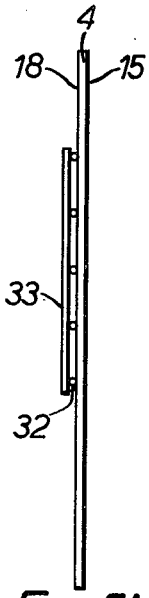
Figure 6:
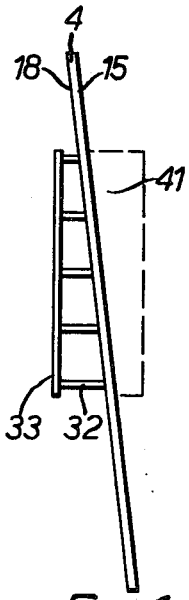
Figure 10A:
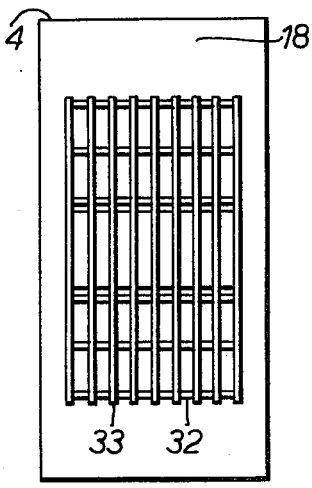
Figure 10B:
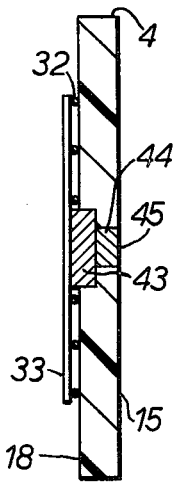
Figure 10C:
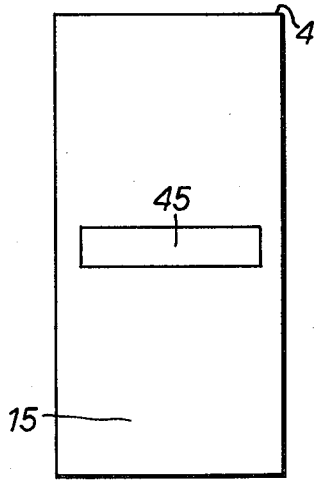

FIGS. 3, 4, 7, 8 and 9 each show a vertical section of an electrochemical apparatus, normal to the plane of the plate-like bipolar member included therein;

FIGS. 5*a* and 5*b* are respectively views of a face and an edge of a first embodiment of plate-like bipolar member;

FIG. 6 is an edge view of a second embodiment of plate-like bipolar member; and FIGS. 10*a*, 10*b* and 10*c* show, respectively, a view of a first face, a section viewed from one edge and a view of a second face of a third embodiment of platelike bipolar member.

Figure 1:
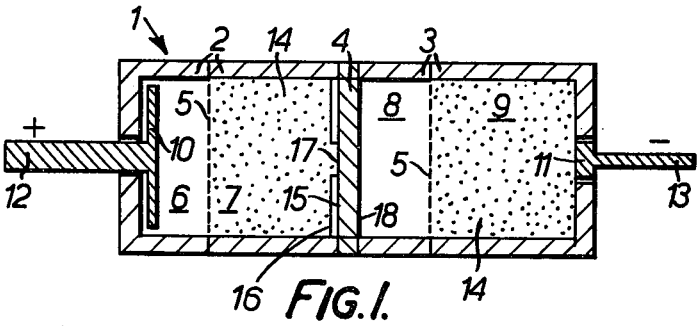
FIG. 1 is a diagrammatic plan view of an electrochemical apparatus.

FIG. 1 shows diagrammatically an electrochemical apparatus 1 comprising two electrochemical cells 2 and 3 constructed of an insulating material. The cells 2 and 3 are separated by a plate-like bipolar member 4 having major faces 15 and 18. A large area of face 15 is coated with insulating paint 16. However, a generaly centrally located area 17 of face 15 is not so painted. Each cell has an ion-permeable diaphragm 5 which separates the cell into two compartments. Cell 2 has compartments 6 and 7 and cell 3 has compartments 8 and 9. The compartments 6 and 9 at each end of the apparatus contain electrodes 10 and 11 which are connected to current conductors 12 and 13 respectively. Compartments 7 and 9 contain a plurality of electroconductive particles 14.

When the electrochemical apparatus is in use, electrolyte is supplied to all four compartments 6 to 9 via conduits and a flow distributor (not shown) in the base of each compartment. An electrical potential difference is applied to the current conductors 12 and 13 so as to render electrode 11 cathodic with respect to electrode 10. The plate-like bipolar member 4 acquires an electrical potential intermediate between that of the electrode 10 and the electrode 11 and is therefore cathodic with respect to electrode 10 and anodic with respect to electrode 11. In use, the exposed area 17 of face 15 acts as a current feeder to the particles 14 which constitute a particulate cathode. Face 18 serves as the site of the anode reaction in cell 3.

Figure 2:
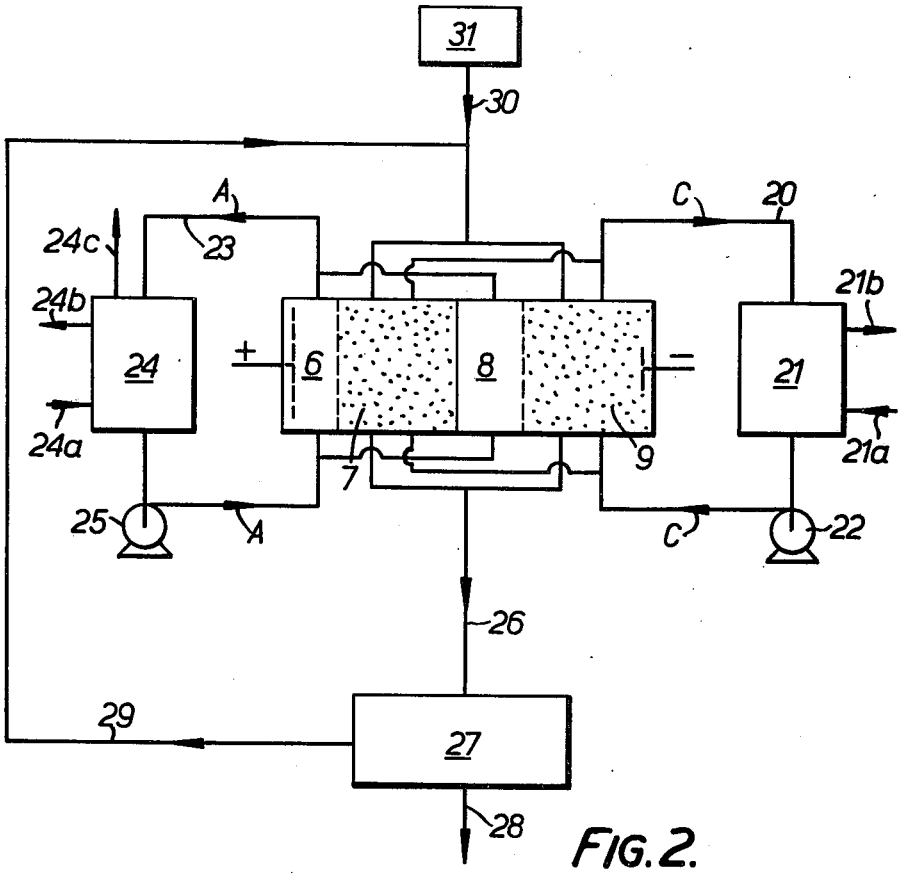
FIG. 2 is a schematically flow sheet for a process conducted in an electrochemical apparatus.

FIG. 2 shows schematically a plant, incorporating the apparatus of FIG. 1, for a continuously operated electrodeposition process. The cathode compartments 7 and 9 of the apparatus are included in a circuit 20 for a catholyte C, the circuit 20 including a circulation tank 21 and a pump 22. The circulation tank 21 is provided with two conduits 21*a* and 21*b*. In a similar arrangement, the anode compartments 6 and 8 of the apparatus are included in a circuit 23 for anolyte A, circuit 23 including a circulation tank 24 and a pump 25. The circulation tank 24 is provided with conduits 24*a* and 24*b* and a vent 24*c*. A branched conduit 26 open to the base of each of the beds of particles 14 in the cathode compartments 7 and 9 connects with a particle classifier 27. The particle classifier 27 is provided with an outlet 28 and a conduit 29 having branches which debouch into the cathode compartments 7 and 9. The conduit 29 has a further branch 30 which connects with a fresh particle dispenser 31.

The operation of the apparatus as shown in FIG. 2 is substantially as described with reference to the apparatus of FIG. 1, anolyte A being fed to the anode compartments 6 and 8 by the pump 25 from the circulation tank 24 and catholyte C being fed to the compartments 7 and 9 by the pump 22 from the circulation tank 21. During the process, the compositions of the anolyte A and the catholyte C in the circulation tanks 24 and 21 respectively is normally maintained substantially constant by bleeding spent solution from the circulation tanks vis the conduits 24*b* and 21*b* respectively and replacing this spent solution with fresh solution fed to the circulation tanks via the conduits 24*a* and 21*a* respectively. The vent 24*c* in the anolyte circulation tank 24 allows any gas evolved at the anodes to escape from the circuit 23. In processes where the diaphragm is ionically permselective and substantially fluid impermeable it may be that the anolyte and catholyte have substantially different compositions. However, when a diaphragm having significant fluid permeability is used, the anolyte and catholyte often have essentially the same composition. They may indeed be circulated from a common tank. During the process, particles on whose surfaces sufficient metal has been electrodeposited to render them too large for continued inclusion in the particulate electrodes are withdrawn from the apparatus and replaced by fresh, small particles. This achieved by withdrawing small quantities of particles from the cathode compartments 7 and 9, either continuously as a trickle flow or by sampling periodically. Particles withdrawn from the cathode compartments 7 and 9 pass along the conduit 26 to the particle classifier 27. Particles which have grown too large for the process are discharged at the outlet 28 of the particle classifier while smaller particles are returned to the cathode compartments along the conduit 29. Fresh small particles in sufficient numbers to maintain the required size distribution in the bed are also introduced into the conduit 29.

Figure 3:
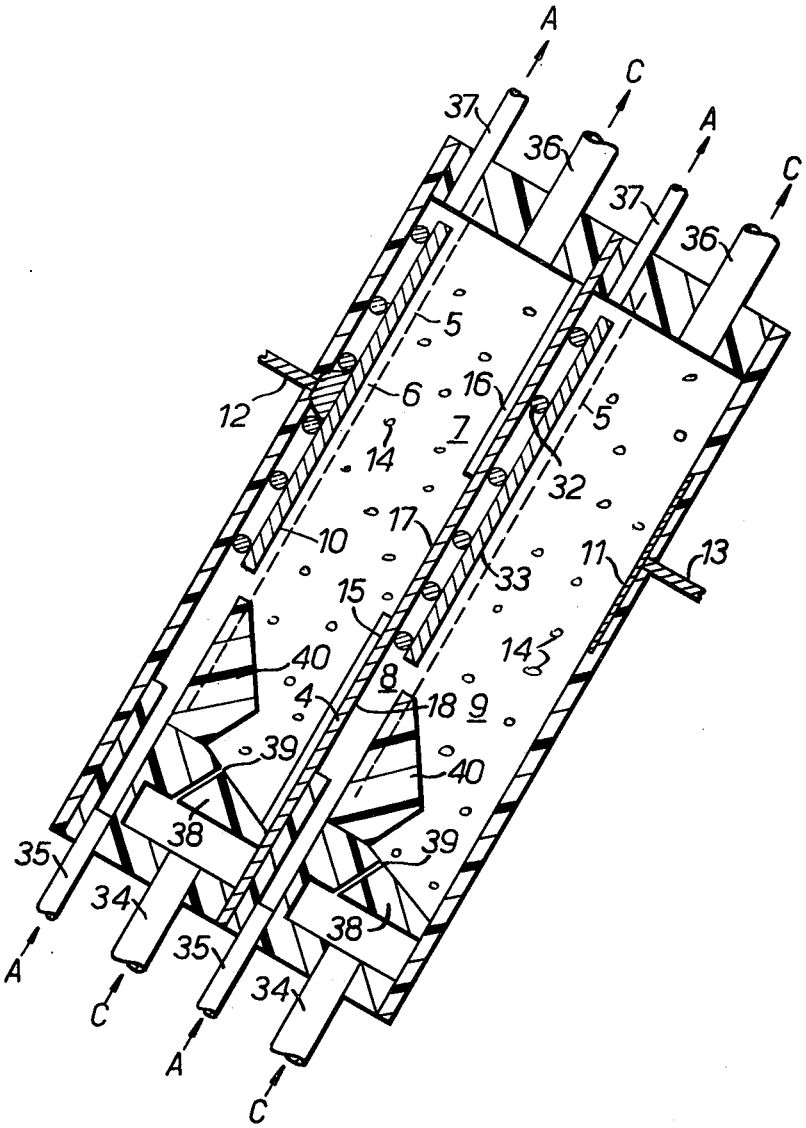

FIG. 3 shows, in vertical section, the construction of one embodiment of apparatus according to the invention which is suitable for inclusion in the plant shown in FIG. 2. The components of the apparatus shown in FIG. 3 correspond generally with those of FIG. 1 and described above with reference thereto, the apparatus being constructed largely of a clear plastics material. In FIG. 3, a generally central portion of the face 18 of the plate-like bipolar member 4 has welded to it a mesh of titanium rods 32 and 33. The mesh has applied to it an electrocatalytic coating, to which reference has been made hereinabove. The mesh of titanium rods 32 and 33 is in close proximity to the diaphragm 5 so as to support the diaphragm when the apparatus is in use. Conduits 34 connect with the bases of the cathode compartments 7 and 9 and conduits 35 connect with the bases of the anode compartments 6 and 8. Conduits 36 and 37 connect with upper parts of the cathode compartments and anode compartments respectively. The conduits 34 debouch into the bases of the cathode compartments 7 and 9 via fow distributors 38 which comprise a plurality of channels 39 situated at the base of wedge:shaped members 40.

When the apparatus is in use, catholyte C is caused to flow upwardly through the conduits 34 and channels 39 at a rate sufficient to agitate the particles 14 in the cathode compartments 7 and 9 and to cause them to circulate in their respective cathode compartments, moving upwardly adjacent the diaphragm 5 and downwardly adjacent the current feeder. Catholyte C passes out of the cathode compartments by means of the conduits 36 which are usually provided with means (not shown) to remove an return to the cathode compartments any small particles 14 carried along with the catholyte. Not shown in FIG. 3 are other means whereby particles are removed from the particulate electrodes for classification and whereby the small particles are returned to the particulate electrodes. Anolyte A is fed to the anode compartments 6 and 8 by conduits 35. The anolyte and any gas evolved at the surface of the anodes pass out of the anode compartments by the conduit 37. The rate of flow of anolyte through the anode compartments is generally not a great as the rate of flow through the cathode compartments containing particulate electrodes. For a process involving electrodeposition of copper from an acid copper sulphate solution, the rate of flow of anolyte through the anode compartments is quite satisfactory so long as it is sufficient to maintain the entire active surface area of the anodes constantly wet with anolyte.

Figure 4:
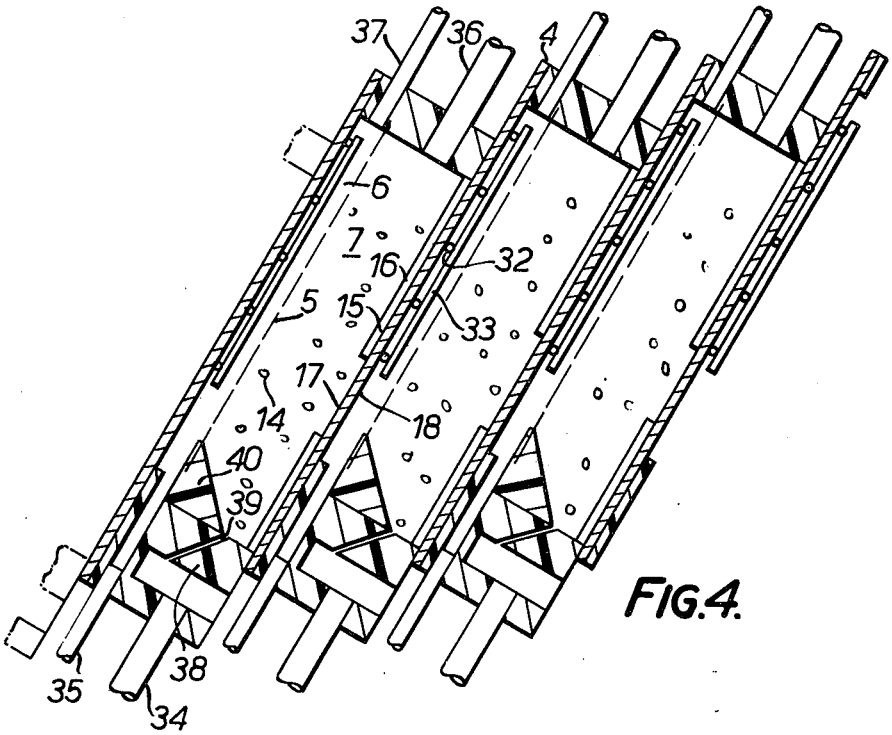

FIG. 4 shows part of a second embodiment of electrochemical apparatus suitable for inclusion in the apparatus shown in FIG. 2. This embodiment has at least five electrochemical cells constructed of a clear plastics material and arranged as an assembly in electrical series. The part of the apparatus shown in FIG. 4 does not include either end of the assembly of cells and so does not show the manner in which, in use, an electrical potential difference is applied to the ends of the assembly. Each cell of the assembly is, in itself, substantially similar in construction and operation to those which are included in the apparatus of FIG. 3, the main difference in construction being the different shape of the wedge-shaped member 40 at the base of each cathode compartment. However, unlike the cells in FIG. 3, the cells of the embodiment of FIG. 4 are disposed in an overlapping or "staggered" relationship to each other so that the assembly may be extended in a generally horizontal direction while the individual cells of the assembly are generally tilted from the vertical direction so that the diaphragms 5 in the assembly are all at an angle of approximately 30° to the upward vertical direction.

FIG. 5*a* shows a face 18 and FIG. 5*b* an edge view of a plate-like titanium member 4 which is suitable for use in, for example, the embodiments of apparatus of FIGS. 3 and 4, as a bipolar member. The face 18 has welded to a generally central part thereof a mesh of titanium rods 32 and 33. The rods 32 and 33 have applied thereto an electrocatalytic coating as referred to hereinabove. The other face 15 of the titanium member 4 has applied to all but a central portion thereof a coating of an insulating paint.

FIG. 6 shows an edge view of another plate-like titanium member 4 which is suitable for use in apparatus which comprises electrochemical cells in which a diaphragm is disposed substantially vertically and in which a particulate electrode is contained in an electrode compartment which is of truncated wedge shape. The face 18 of the titanium member 4 has a mesh of titanium rods 32 and 33 arranged so that the rods 33 lie in a plane which is not parallel to the plane of the titanium member 4. To the other face 15 of the titanium member 4 are welded a number of fins 41 which project normally from the plane of the titanium member 4.

When the plate-like titanium member 4 of FIG. 6 is in use, the fins 41 function as a part of a current feeder to a particulate electrode which contacts the face 15. The face 15 of the titanium member 4 may be uncoated so that, in use, a large part of its surface area is electrically active. Alternatively, the face 15 of the titanium member 4 may be coated with an insulating paint except in the area around the fins 41. In this case, only the area of the face 15 around the fins 41 functions, in use, as a current feeder to the particulate electrode.

Figure 7:
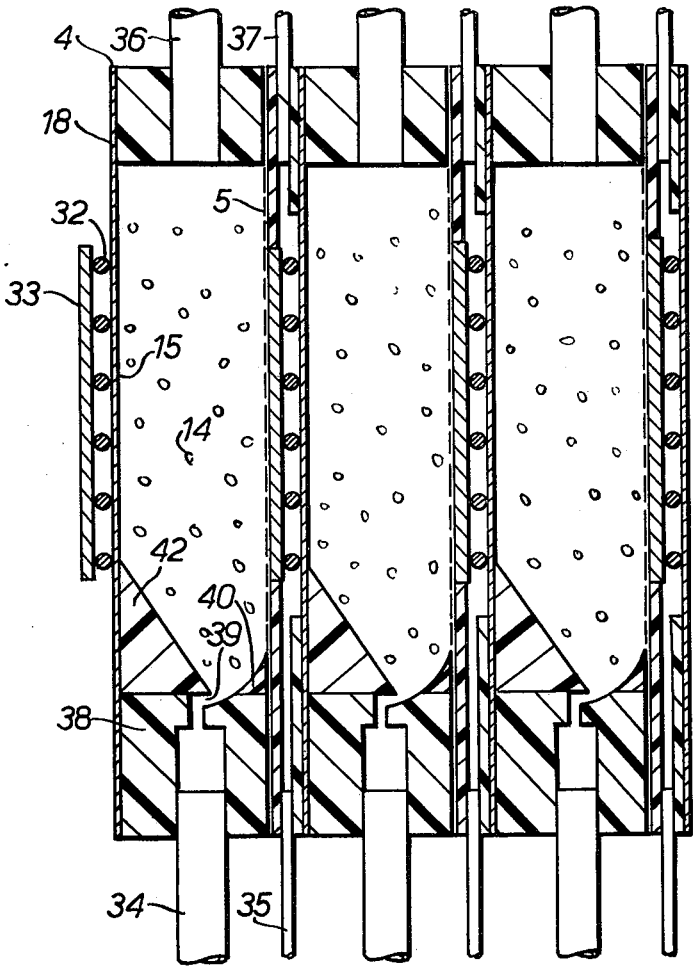

FIG. 7 shows another embodiment of apparatus which may be suitable for use in, for example, apparatus as shown in FIG. 3. As in FIG. 4, the cell at each end of the assembly of cells are not shown. The construction and operation of the cells shown in FIG. 7 is substantially similar to that of the cells of FIG. 4. However, in the cells of FIG. 7, the planes of both the diaphragms 5 and bipolar members 4 are substantially vertically arranged, in contrast to the apparatus of FIGS. 3 and 4 in which these planes are tilted out of the vertical plane. The flow distributors 38 of the cells shown in FIG. 7 have a relatively small wedge-shaped member 40 adjacent the diaphragms 5 but have a larger wedge-shaped member 42 adjacent the bipolar members 4. We have found from our experiments that, in process of electrodeposition from aqueous solutions of metal sulphates, this configuration of electrochemical cell does not operate as efficiently as the titled configuration shown in FIG. 3.

Figure 8:
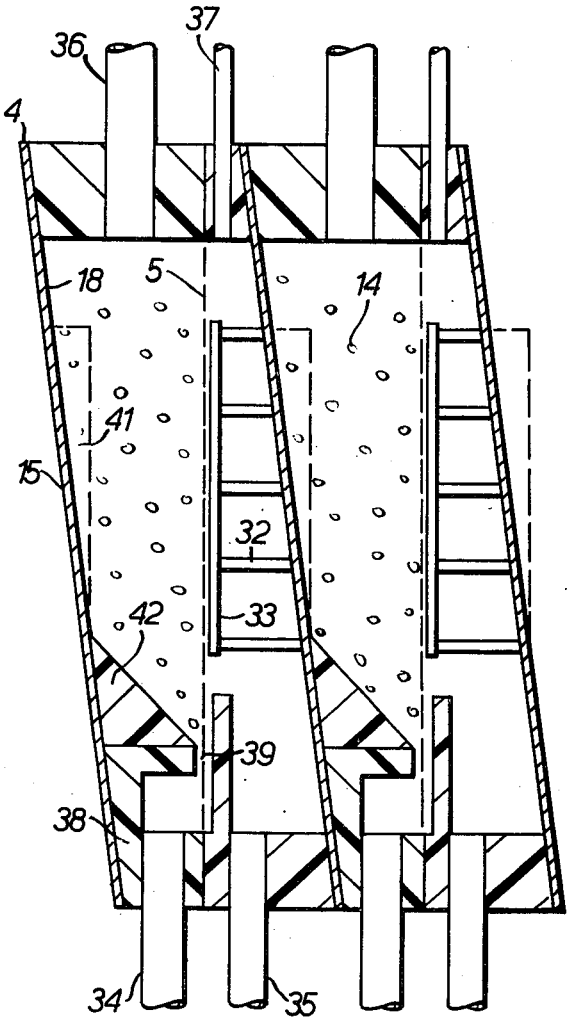

FIG. 8 shows a modified form of the apparatus shown in FIG. 7. The apparatus of FIG. 8 includes as bipolar members the plate-like member 4 of FIG. 6. The cells have vertical diaphragms and cathode compartments of truncated wedge-shaped section which contain particulate electrodes. Each flow distributor 38 comprises a single channel 39 which extends for substantially the whole width of the electrode compartment. One wall of the channel 39 is formed by the diaphragm 5. Above the flow distributors 38 are large wedge-shaped members 42 adjacent the bipolar members 4.

Figure 9:
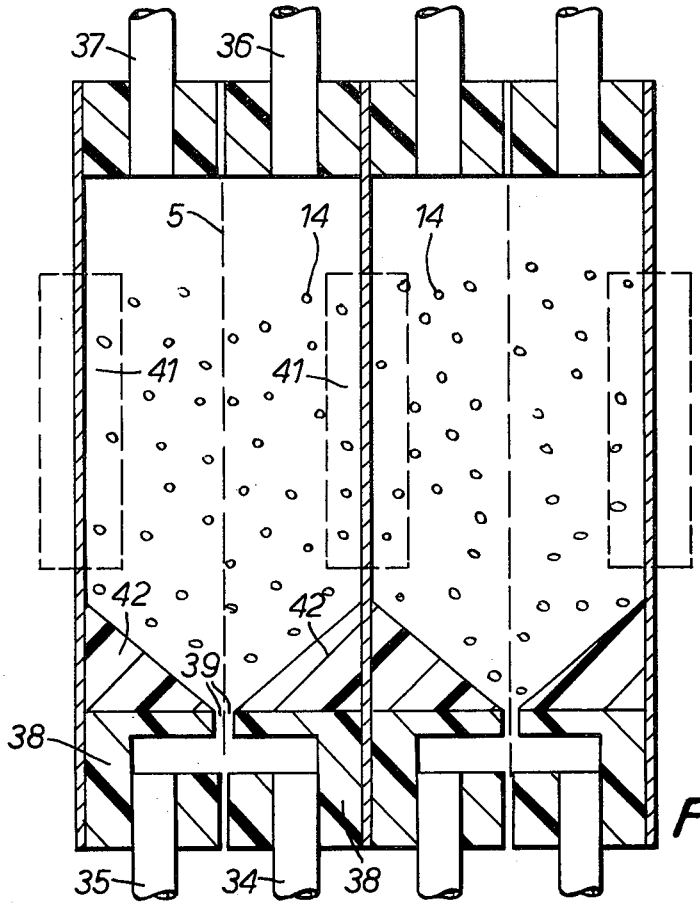

FIG. 9 shows an embodiment of apparatus suitable for inclusion in for example, the apparatus of FIG. 3, in which each cell has two particulate electrodes separated by a generally vertical diaphragm. The bipolar members separating each cell comprise a generally vertical sheet of titanium to each side of which are welded fins 41.

When this embodiment of apparatus is in use, both major faces of the bipolar members 4 act as current feeders to the respective particulate electrodes with which they are in contact. The embodiments of FIGS. 8 and 9 may have application in certain electrochemical processes such as those which employ poorly electroconductive electrode particles of a density which is low compared to that of most metals. However, our experiments appear to show that these embodiments are generally less satisfactory than, for example, that of FIG. 3 for processes of electrodeposition on metallic electrode particles.

FIG. 10 shows a further embodiment of plate-like member 4 which may be suitable for use in, for example, apparatus as shown in FIGS. 3 and 4 when used for a process of, for example, electrodeposition of copper from aqueous solutions of copper salts. The plate-like member 4 is formed of a sheet of an insulating material, into a central portion of which is fitted a strip of titanium 43 to which is welded a strip of copper 44. The copper strip 44 has a face 45 which is flush with the face 15 of the member 4. The strip of titanium 43 stands proud of the face 18 of the member 4. To it is welded a plurality of titanium rods 33 which form a mesh of titanium rods with a further plurality of titanium rods 32 to which they are welded. The mesh of rods 32 and 33 is coated with an electrocatalytic coating as described above.

When the plate-like member 4 of FIG. 10 is in use in an apparatus such as that of FIG. 3 or 4, it is arranged so that its face 15 is in contact with a particulate electrode. In use, the copper strip 44 functions as a current feeder to the particulate electrode while the mesh of titanium rods 32 and 33 serves as an anode in the adjacent cell.

The invention will now be illustrated by the following Examples.

EXAMPLE 1

An assembly of two electrochemical cells similar to the apparatus shown schematically in FIG. 3 was employed to electrodeposit copper from a solution of copper sulphate and sulphuric acid in a batch run lasting about 10 hours. The equipment used in this run was substantially as shown schematically in the flow sheet of FIG. 2.

Each of the two electrochemical cells had an internal width of 450 mm, height 640 mm and thickness 50 mm.

The bipolar member between the two cells was formed from a titanium plate. On the cathodic face of the bipolar member much of the surface was coated with a non-conductive coating of metal oxides. However, a small area of the titanium plate was left bare so as to act as current feeder to the particulate cathode. A mesh of vertical and horizontal titanium rods was welded to the anodic face of the bipolar member over an area about 160 × 160 mm. This area of the anodic face of the bipolar member was then coated with an electrocatalytic coating to which reference has been made hereinbefore. The diaphragm separating the anode and the cathode compartments of each cell was of "Darak 5000," a material made by W.R. Grace & Co. The assembly of cells was tilted so that the diaphragms were inclined at an angle of about 28° to the upward vertical and so as to overlie the particulate cathode with which they were in contact. The particles of the particulate cathodes were of copper and were in the size range of from 200 to 800 microns diameter. The anolyte and catholyte were essentially of the same composition.

The conditions under which the assembly of cells were operated were as follows:

| | | |
|---|---|---|
| Catholyte flow rate | | 2.5 $m^3$/h/cell |
| Anolyte flow rate | about | 200 l/h/cell |
| Overall volume expansion of bed of particles of cathode | about | 5% |
| Electrolyte temperature | | 35° C |
| Initial electrolyte composition (final conditions in brackets) | | |
| Cu | 25 | (0.05) g/l |
| $H_2SO_4$ | 100 | (138) g/l |
| Current density (with respect to available diaphragm area | | 1000 A/$m^2$ |
| Voltage across each cell | | 1.7 V |
| Overall cathode efficiency | higher than 95% | |

EXAMPLE 2

The assembly of two electrochemical cells employed in the process of Example 1 was operated continuously for a period of 100 hours. Metered quantities of saturated catholyte solution were added to the circulation tank and spent solution was withdrawn from the tank, at rates sufficient to maintain the composition of the catholyte in the circulation tank substantilly constant. The conditions under which the continuous process was operated were as given below:

| | |
|---|---|
| Catholyte flow rate | 2.5 $m^3$/h/cell |
| Anolyte flow rate about | 200 l/h/cell |
| Overall solid volume expansion of bed of particles of cathode about | 5% |
| Electrolyte temperature | 35° C. |
| Saturated solution composition: | |
| Cu | 25 g/l |
| $H_2SO_4$ | 100 g/l |
| Spent solution composition: | |
| Cu | |
| $H_2SO_4$ | 131 g/l |
| Feed rate of saturated solution | 19 l/h |
| Current density | 1000 A/$m^2$ |
| Voltage across each cell | 1.7 V |
| Overall cathode efficiency | higher than 95% |
| Copper production | 180 g/h/cell |

We claim:

1. An electrochemical apparatus which includes at least two electrochemical cells separated from ech other by an impermeable bipolar means having a plate-like portion which defines a boundary between an electrode compartment of a first polarity in one of the electrochemical cells and an electrode compartment of an opposite polarity in the other of the electrochemical cells, the bipolar means having at least a portion of one face thereof substantially planar, wherein each of said cells comprises at least one particulate electrode, a counter electrode and means for preventing an electrical short circuit between particles of the particulate electrode and the counter electrode, wherein the bipolar means provides an electrical connection between the particulate electrode of one cell and the counter electrode of the other cell, and wherein at least the substantially planar portion of said one face of the bipolar means is in electrical contact with the particulate electrode and is a current feeder for the particulate electrode.

2. An apparatus as claimed in claim 1, wherein each cell has two electrode compartments separated by an ion-permeable diaphragm.

3. An apparatus as claimed in claim 2, wherein said ion-permeable diaphragm is substantially fluidim-permeable and is ionically permselective.

4. An apparatus as claimed in claim 2 wherein the bipolar means is of generally planar configuration and wherein the bipolar means is disposed within the electrochemical apparatus so as to be substantially parallel to the ion-permeable diaphragms.

5. An apparatus as claimed in claim 2, wherein said counter electrode is not a particulate electrode.

6. An apparatus as claimed in claim 5, wherein the active surface area of the bipolar means which, in use, constitues a current feeder for the particulate electrode and the active surface area of the counter electrode are in a ratio of from 1:2 tio 1:10.

7. An apparatus as claimed in claim 5 wherein the particulate electrodes are cathodes and wherein the ion-permeable diaphragms are inclined from the vertical to overlie the particulate electrodes with which they are in contact, the apparatus being further provided with means to circulate the particles of each particulate electrode in their respective electrode compartments.

8. An apparatus as claimed in claim 7 wherein the ion-permeable diaphragms are inclined at an angle from the upward vertical which is in the range of from 5° to 40°.

9. An apparatus as claimed in claim 1, wherein the bipolar means includes a grid or mesh of titanium, mounted on said plate like portion which functions as an anodic counter electrode during use of the apparatus.

10. An apparatus as claimed in claim 9, wherein at least a part of said grid or mesh has a coating of an electrocatalytic material.

11. An apparatus as claimed in claim 1 wherein the current feeder portion of the bipolar means has an area which is not more than 50% of the area of the bipolar member which, in use, is in contact with the particulate electrode.

12. An apparatus as claimed in claim 1 wherein the current feeder portion of the bipolar means comprises a metal whose composition is substantially the same as that of the surfaces of substantially all the particles of the particulate electrode which it contacts.

13. An apparatus as claimed in claim 1 wherein said at least two cells comprises from 5 to 100 electrochemical cells arranged so as to have a configuration similar to that of a plate filter press.

14. A process for the electrodeposition of a metal from an aqueous electrolyte onto the particles of at least two particulate cathodes which process comprises the steps of flowing the aqueous electrolyte through cathode compartments of the cells of an apparatus as claimed in claim 1, and establishing a potential difference betwen the particulate electrode and the counter electrode of each cell of the apparatus by supplying current to the particulate electrodes of the cells through substantially planar surface portion of an impermeable bipolar means having said platelike portion which defines the boundary between the cathode compartment of each cell and the anode compartment of its adjacent cell, which potential difference is such as to render the particulate electrode in each cell of the apparatus cathodic with respect to the counter electrode of the cell whereby metal is electrodeposited from the electrolyte onto the particles of each particulate electrode.

* * * * *